US009746298B2

(12) United States Patent
Minnicino, II

(10) Patent No.: US 9,746,298 B2
(45) Date of Patent: Aug. 29, 2017

(54) FLECHETTE FOR DIRECT FIRE WEAPONS

(71) Applicant: U.S. Army Research Laboratory ATTN: RDRL-LOC-I, Adelphi, MD (US)

(72) Inventor: Michael A. Minnicino, II, Baltimore, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 463 days.

(21) Appl. No.: 14/446,370

(22) Filed: Jul. 30, 2014

(65) Prior Publication Data

US 2016/0363425 A1 Dec. 15, 2016

(51) Int. Cl.

| | |
|---|---|
| ***F42B 12/64*** | (2006.01) |
| ***F42B 10/08*** | (2006.01) |
| ***F42B 12/74*** | (2006.01) |
| ***F42B 12/06*** | (2006.01) |

(52) U.S. Cl.

CPC ..... *F42B 12/64* (2013.01); *F42B 10/08* (2013.01); *F42B 12/06* (2013.01); *F42B 12/74* (2013.01)

(58) Field of Classification Search

CPC ..... F41B 14/06; F41B 14/061; F41B 14/062; F41B 14/064; F41B 14/065; F41B 14/067; F41B 14/068; F41A 21/00; F41A 21/02; F41A 21/04; F41A 21/10; F41A 21/16; F41A 21/46

USPC ..... 102/517, 520, 521, 522, 523, 524, 525, 102/526, 527, 528, 529; 42/76.01, 79; 89/14.05, 14.6

See application file for complete search history.

(56) References Cited

U.S. PATENT DOCUMENTS 3,011,404 A * 12/1961 Russell ..... F41A 1/04 102/431
3,148,472 A * 9/1964 Hegge ..... F42B 14/02 102/521
3,412,681 A * 11/1968 Schirneker ..... F42B 5/035 102/438
3,450,050 A * 6/1969 Robinson ..... F42B 5/035 102/506
4,126,955 A * 11/1978 Coffield, Jr. ..... F41A 21/16 102/430
4,516,502 A * 5/1985 Klein ..... F42B 5/03 102/489

(Continued)

*Primary Examiner* — Bret Hayes
(74) *Attorney, Agent, or Firm* — Alan I. Kalb

(57) ABSTRACT

A flechette for use with a gun barrel having a tapered bore with a diameter at the initial bore section greater than the diameter at the emergent bore. The flechette includes a body constructed of a ductile material and having an elongated axis aligned with the axis of the tapered bore when positioned in the load end of the bore. The body also includes a cylindrical bulkhead as well as a bourrelet that are axially spaced from each other along the flechette and have an outside diameter substantially the same as the diameter at the initial bore section of the tapered bore. An elongated boom is attached at the tail end of the body while a penetrator is attached at the forward end of the body. Upon launch, both the bulkhead and bourrelet are compressed radially inward by the bore reduction so that the body is substantially cylindrical upon exit from the discharge end of the bore.

4 Claims, 2 Drawing Sheets

(56) References Cited

U.S. PATENT DOCUMENTS

| | | | | | |
|---|---|---|---|---|---|
| 4,527,348 | A * | 7/1985 | Brennan | F41A 21/16 | 42/76.01 |
| 4,770,102 | A * | 9/1988 | Bisping | F42B 12/06 | 102/501 |
| 4,901,645 | A * | 2/1990 | Bisping | F42B 12/06 | 102/501 |
| 7,748,325 | B2 * | 7/2010 | Marx | F42B 12/34 | 102/501 |

* cited by examiner

FLECHETTE FOR DIRECT FIRE WEAPONS

GOVERNMENT INTEREST

The invention described herein may be manufactured, used, and licensed by or for the United States Government.

BACKGROUND OF THE INVENTION

I. Field of the Invention

The present invention relates generally to munitions and, more particularly, to a flechette for use with a direct fire weapon.

II. Description of Relevant Art

There have been many previously known flechettes which are often described as a dart-like projectile with a diameter much smaller than the gun bore diameter that is used to launch the flechette. Oftentimes, a plurality of flechettes are contained within a single shell so that a plurality of flechettes may be launched en masse simultaneously.

In other cases, a flechette is individually fired from a gun using a discarding sabot. In these previously known individually fired flechettes, the sabot has an outside diameter substantially the same as the bore diameter of the gun bore in order to prevent high-pressure gases resulting from the deflagration of propellant from passing the flechette during launch. Upon exit from the gun bore, however, the sabot is immediately discarded from the flechette.

One disadvantage of using flechettes with discarding sabots, however, is that the discarded sabot trajectory is random upon muzzle exit. As such, flechettes generally are not used in situations where friendly troops may be struck by the discarded sabot. Consequently, the use of these previously known individually fired sabots is limited.

SUMMARY OF THE PRESENT INVENTION

The present invention provides an individually fired flechette for use with a tapered bore gun which overcomes the above-mentioned disadvantages of the previously known flechettes.

In a tapered bore gun, the gun barrel includes the chamber, forcing cone, and the tapered bore. The tapered bore begins at the minimum diameter of the forcing cone and continues to the gun muzzle. The diameter of the tapered bore at its origin is referred to as the initial bore diameter. The diameter of the tapered bore at the muzzle is referred to as the emergent bore diameter. The emergent bore diameter at the gun muzzle is smaller than the initial bore diameter in a tapered bore gun. The taper profile of the tapered bore gun may continuously decrease from its origin to the muzzle or may consist of a constant initial bore diameter section followed by a transitional tapered bore section and then optionally followed by an emergent bore diameter section. For discussion purposes, the tapered bore gun herein possesses a constant initial diameter, e.g. .308 caliber, to a point prior to the muzzle followed by a short tapering section of the gun bore that reduces the gun bore to the smaller emergent bore diameter, e.g. 0.150 caliber, followed by a short length of constant, emergent diameter bore, e.g. 0.150 caliber. The use of such tapered bore guns enjoys several advantages, one of which is increased projectile exit velocity.

The flechette of the present invention includes an elongated body constructed of a ductile material, such as copper or brass. A generally cylindrical bulkhead as well as a bourrelet extend radially outwardly from a smaller diameter portion of the body so that the outer diameter of both the bulkhead and the bourrelet is substantially the same diameter as the initial bore diameter of the tapered bore gun. The bourrelet, furthermore, is generally conical in shape with a base of the cone facing forward and axially spaced from the bulkhead.

A penetrator, which may be constructed of any suitable material, is attached to the forward end of the body. The penetrator has an outside diameter less than the bulkhead and bourrelet and preferably substantially the same or slightly smaller than the size of the emergent bore diameter at the gun muzzle.

An elongated boom is attached to the rear end of the body to aerodynamically stabilize the flechette after launch from the gun bore. The boom generally has an outside diameter less than the emergent bore diameter at the muzzle of the gun and also preferably includes an enlarged diameter tail for added flight stability.

The projectile cartridge is the assembly of the flechette, propellant, primer, and shell casing. Different mechanisms may be used to launch the flechette. However, typically a shell casing containing propellant is provided around the boom of the flechette up to the bulkhead. Consequently, with the flechette contained within a shell casing positioned within the gun chamber, the flechette body is positioned within the gun bore at the gun forcing cone, upon launch the flechette traverses the gun forcing cone and the flechette's bulkhead prevents the high-pressure gases from the deflagration of the propellant from leaking around the flechette thus increasing the launch velocity of the flechette. Simultaneously, as the flechette travels through the larger diameter end of the bore, the bulkhead and bourrelet act to provide a wheelbase to maintain the flechette axially aligned with the gun bore.

As the flechette passes through the tapered portion of the gun bore, both the bourrelet and bulkhead are compressed radially inward so that the body becomes cylindrical in shape as the flechette passes into the smaller, emergent bore diameter adjacent the muzzle of the gun. The inward compression of both the bulkhead and bourrelet, furthermore, also effectively increases the overall length of the flechette from the original length of the flechette prior to launch.

A primary advantage of the flechette of the present invention is that it is completely self-supporting and does not require a discarded sabot used with the previously known flechettes.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
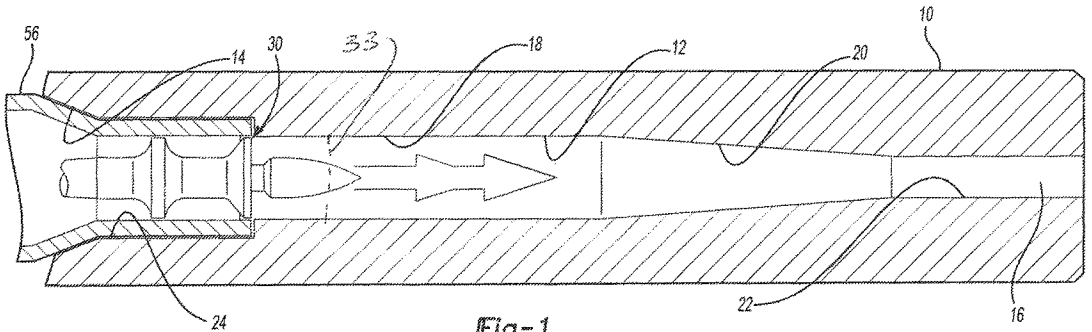
FIG. 1 is a longitudinal sectional view of an exemplary gun barrel having a tapered bore.

With reference first to FIG. 1, a simplified gun barrel is there shown diagrammatically. The gun barrel 10 includes a gun bore 12 extending from near the chamber at the origin of the bore 33 to the muzzle 16 of the gun barrel 10. This tapered bore 12 includes an initial bore section 18 having a constant caliber or diameter followed by an inwardly tapered section 20 and an emergent bore section 22 having a constant diameter and which extends to the muzzle 16 of the barrel 10. The diameter of the emergent bore section 22 following the tapered section 20 is much smaller than the constant caliber, initial bore section 18 of the gun bore 12. For example, the diameter of the gun's initial bore section 18 may be .308 caliber while the constant caliber emergent bore section 22 of the bore 12 has a smaller caliber, e.g. 0.150 caliber. Consequently, for this example, the tapered section 20 of the gun bore 12 achieves a better than 2 to 1 reduction in caliber. A loading chamber 24 dimensioned to contain the shell with the launch propellant is also provided in the barrel 10.

Figure 2:
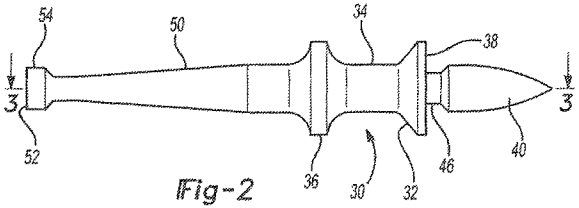
FIG. 2 is a side view illustrating a preferred embodiment of a flechette according to the present invention prior to launch.
Figure 3:
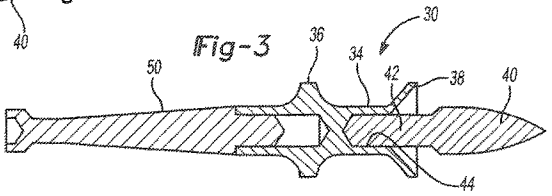
FIG. 3 is a longitudinal sectional view of the flechette of the present invention prior to launch and taken along line 3-3 in FIG. 2.

With reference now to FIGS. 2 and 3, a flechette 30 according to the present invention is shown having a body 32 constructed of a ductile material, such as copper, brass, or other ductile alloys. The body 32 includes a reduced diameter midportion 34 with an enlarged diameter bulkhead 36 protruding radially outwardly from the reduced diameter midportion 34 of the body 32. The outside diameter of the bulkhead 36 is substantially the same as the diameter of the initial bore section 18 of the gun barrel 12.

A generally conical bourrelet 38 extends radially outward from the midportion 34 of the flechette body 32 adjacent the forward end of the body 32. This bourrelet is generally conical in shape with its conical base facing toward the muzzle having an outside diameter the same or substantially the same as the larger diameter bore 18 of the gun barrel and thus substantially the same as the bulkhead 36.

Still referring to FIGS. 2 and 3, a low aerodynamic drag shaped or cone-shaped penetrator 40 is attached to a forward end of the body 32. Any conventional means may be used to attach the penetrator 40 and body 32 together. However, as shown, the penetrator includes a shaft 42 that is received within a receiving hole 44 in the body 32. Any conventional means, such as a press fit, threaded connection, adhesive, or the like may be used to secure the penetrator 40 to the body 32.

The penetrator 40 is constructed of any hard and/or dense material of the type used in flechettes. In addition, the diameter of the penetrator 40 at its greatest diameter is substantially the same or less than the midportion 34 of the body 32 and also substantially the same or less than the diameter of the emergent bore 22 of the barrel gun bore 12.

Still referring to FIGS. 2 and 3, the penetrator 40 preferably includes a reduced diameter shaft 42 protruding rearward from the bulk of the aerodynamic penetrator to connect to the body 32.

An elongated boom 50 extends rearwardly from the body 32. This boom tapers radially inward from the body 32 and to a rear end 52 of the boom 50. Preferably, however, for increased stability, a tail 54, which can be a fin, a flare, or a cone, is provided at the rear or free end of the boom 50 for increased aerodynamic stability of the flechette during flight. The boom 50 may be constructed of any suitable material, such as aluminum, steel, etc.

Although any means may be used to launch the flechette 30, an individually fired flechette 30 will typically include a shell casing 56 dimensioned to fit within the firing chamber 24 (FIG. 1) of the gun barrel 10. In the conventional fashion, the shell casing 56 is filled with a propellant which, when ignited, propels the flechette 30 through the bore 12 of the gun barrel 10.

In operation, the shell casing 56 is positioned within the firing chamber 24 which simultaneously positions the bulkhead 36 in a forcing cone 14 and bourrelet 38 within the initial bore section 18 of the gun bore 12 at a beginning 33 of the initial bore section 18 of the gun bore 12. Upon firing, the bulkhead 36 traverses the forcing cone becoming radially compressed and obturating the high-pressure gases produced by the deflagration of the propellant initially contained in the shell casing 56 thereby ensuring maximum acceleration and velocity for the flechette 30. Consequently, the exterior surfaces of the flechette 30, rear of the bulkhead 36, are exposed to the propellant gases. Furthermore, since the bulkhead 36 and bourrelet 38 are axially spaced from each other, the bulkhead 36 and bourrelet 38 form a wheelbase during launch to keep the flechette centered in the gun bore 12.

Figure 4:
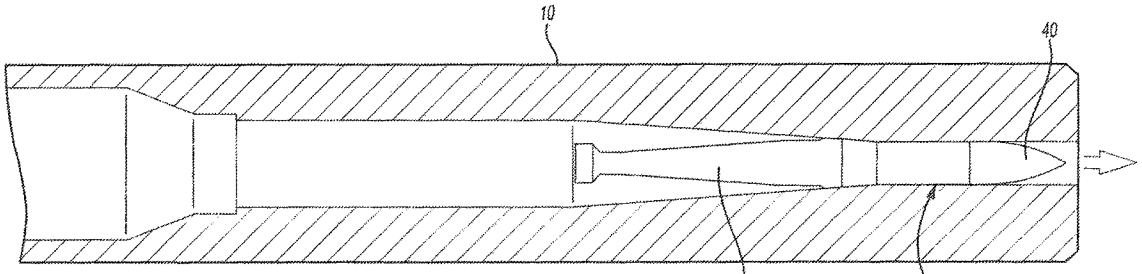
FIG. 4 is a fragmentary longitudinal sectional view illustrating the flechette as it passes through the tapered portion of the gun bore.
Figure 5:
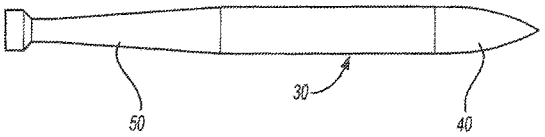
FIG. 5 is a side view illustrating the flechette upon discharge from the gun bore.

With reference now to FIG. 4, as the flechette body 32 passes through the tapered portion 20 of the gun bore 12, the tapered portion 20 radially inward compresses both the bourrelet 38 and bulkhead 36 radially inward. In doing so, the bourrelet 38 compresses forwardly around the reduced diameter shaft 42 of the penetrator 40. The inward compression of the bulkhead 36, furthermore, effectively lengthens the flechette 30 as shown in FIG. 5.

As the flechette passes through the tapered portion 20 of the gun bore 12 and into the smaller diameter, emergent bore section 22 of the gun bore 12, the flechette body 32 becomes cylindrical in shape with a diameter equal to the diameter of the smaller diameter, emergent bore section 22. Furthermore, since the emergent bore diameter is substantially equal to the diameter of the penetrator 40 at its base as well as the diameter of the boom 50 at its attachment with the body 32, the flechette 30 is formed into an aerodynamic projectile with extreme muzzle velocity and very low aerodynamic drag. In addition, after launch the tail 54 of the boom 50 stabilizes the flight of the flechette.

From the foregoing, it can be seen that the flechette of the present invention provides several advantages over the previously known flechettes. First, unlike the previously known flechettes, a high compression ratio, i.e. two or more, can be achieved from the initial caliber of the gun bore and to the final caliber of the gun bore. In addition, the flechette of the present invention is self-supporting by both the bulkhead and bourrelet so that the use of a discarding sabot is not required. As such, the flechette of the present invention may be used even in crowded troop conditions.

A still further advantage of the present invention is that the flechette is completely self-forming so that its pre and post launch geometries are significantly different from each other. The flechette of the present invention further uses a compressible bulkhead and forward folding bourrelet which enables the final geometry of the flechette after launch from the discharge end of the gun to be easily formed. As such, the flechette of the present invention enjoys not only low aerodynamic drag, but also extreme muzzle velocity.

Having described my invention, many modifications thereto will become apparent to those skilled in the art to which it pertains without deviation from the spirit of the invention as defined by the scope of the appended claims.

I claim:

1. A self-forming and self-supporting flechette that does not require discarding sabots for use with a gun barrel having a tapered bore in which a diameter at an initial bore located nearer a gun chamber is greater than a diameter at an emergent bore located nearer a gun muzzle, the flechette comprising:

a body constructed of a ductile material and having an axis aligned with an axis of a tapered bore when positioned in an initial bore section of a tapered gun bore, said body having a cylindrical bulkhead with a diameter substantially equal to the diameter at the initial bore section of said tapered bore and a cylindrical bourrelet with a diameter substantially equal to the diameter at an initial bore section of said tapered bore, said bourrelet being spaced axially forwardly of said cylindrical bulkhead in said tapered bore, having a forward facing end of said bourrlet that is concave in shape, a cone shaped penetrator axially aligned with and attached to a forward end of said body and having a diameter at one end the same as a bore diameter, a boom axially aligned with and attached to a rear end of said body, said body being substantially cylindrical in shape upon exit from a discharge end of said bore, and said boom tapers radially inwardly from said body and to a point adjacent a free end of said boom, said boom having a tail from said point and to said free end of said boom.

2. The flechette as defined in claim 1 wherein said tail comprises a fin, a flare, or a cone.

3. The flechette as defined in claim 1, wherein said body comprises copper.

4. The flechette as defined in claim 1, wherein said body comprises brass.

* * * * *